United States Patent [19]

Bachtell

[11] 4,296,765

[45] Oct. 27, 1981

[54] METHOD AND APPARATUS FOR SECURING A HAIRPIECE

[76] Inventor: Stephen R. Bachtell, 1727 Crystal La., Mt. Prospect, Ill. 60056

[21] Appl. No.: 970,104

[22] Filed: Dec. 18, 1978

[51] Int. Cl.[3] ..... A41G 3/00

[52] U.S. Cl. ..... 132/53

[58] Field of Search ..... 132/5, 53, 54

[56] References Cited

U.S. PATENT DOCUMENTS

| | | | |
|---|---|---|---|
| 2,621,663 | 12/1952 | Jenkins | 132/5 |
| 3,605,761 | 9/1971 | Margo | 132/5 |
| 3,811,453 | 5/1974 | Bretton | 132/53 |
| 3,970,092 | 7/1976 | Nelson | 132/53 |
| 3,977,335 | 8/1976 | Bonham | 132/5 |

*Primary Examiner*—G. E. McNeill

*Attorney, Agent, or Firm*—Leydig, Voit, Osann, Mayer & Holt, Ltd.

[57] ABSTRACT

A method is provided for attaching a hairpiece to the head of a recipient having some natural hair. The hairpiece has a plurality of loops about which natural hair can be secured that are disposed on the hairpiece so as to be adjacent natural hair when the hairpiece is in position. At each of a plurality of loops, a first adjacent group of natural hair is pulled through the loop and held outwardly extended from the recipient's head under controlled tension. A second adjacent group of natural hair is then held outwardly extended from the recipient's head under controlled tension in an orientation such that the two groups cross against each other over the loop and the loop is snuggly disposed against the recipient's head. A line is tied about the two groups where they cross, and a flowable adhesive is applied to the knotted line.

2 Claims, 6 Drawing Figures

METHOD AND APPARATUS FOR SECURING A HAIRPIECE

BACKGROUND OF THE INVENTION

The present invention relates to a method and apparatus for attaching a hairpiece to the head of a recipient who has lost a portion of his natural hair and wishes to artificially replace the lost hair.

Previously known methods for attaching haipieces have used, at least in part, the recipient's own hair as a means for securing the hairpiece. U.S. Pat. No. 3,870,792 describes a method of attaching hairpieces of the type having a base formed from open-hole netting in which separate groups of natural hair are pulled up through adjoining holes in the netting, the groups of hair are twisted together and tied into knots, and glue is applied to the knotted hair so that it holds the hairpiece in place. However, this method, and methods of this type, have not been entirely satisfactory.

In practice of the known methods, it has been cumbersome and difficult to hold, twist, and knot the hair securely, and at the same time apply the glue. It has also been difficult to knot the hair close enough to the recipient's scalp so that the hairpiece is secured without undesired slippage. When trying to make sufficiently tight knots to prevent slippage, the tension that the operator exerts on the hair frequently causes pain of discomfort to the recipient, and it has been difficult for the operator to judge when he is pulling too hard. Still a further drawback in such prior practices has been that the natural hair must be relatively long to enable it to be adequately twisted and knotted. This has prevented such attachment methods from being used when the recipient either did not have long hair or desired a shorter hair style.

SUMMARY OF THE INVENTION

It is an object of the present invention to provide an easier and more reliable method of securing a hairpiece to the head of a recipient.

Another object is to provide a method of securing a hairpiece to the head of a recipient which utilizes the recipient's natural hair, but which does not require cumbersome twisting or knotting of the hair, and which enables both hands of the operator to be free to fasten the recipient's natural hair to the hairpiece.

A further object is to provide a method as characterized above which results in stronger bonds, and holds the hairpiece in closer and firmer engagement with the head.

Still another object is to provide a hairpiece attaching method of the above kind which can be readily used for short hairstyles.

Yet another object is to provide an apparatus for use in the foregoing method which permits natural hair to be held under predetermined, uniform tension during the attaching procedure. A related object is to provide such an apparatus which is adapted to permit adjustment of the tension during the attaching process in order to suit the comfort and hair type of the individual recipient.

Other objects and advantages of the invention will become apparent from the following detailed description and upon reference to the drawings.

DETAILED DESCRIPTION OF THE PREFERRED EMBODIMENT

Figure 1:
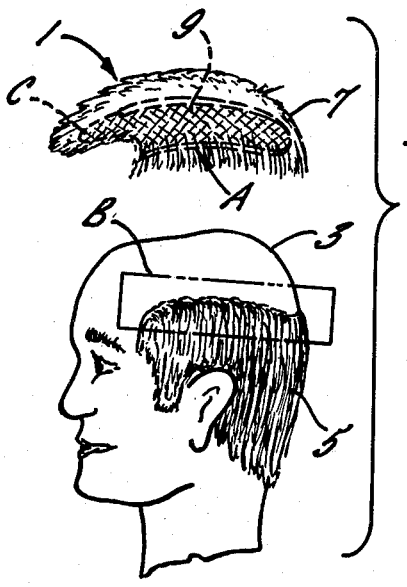
FIG. 1 is a side view of the head of a recipient together with a hairpiece suitable for attachment to the recipient's head.

Briefly, the drawings illustrate a process of attaching a hairpiece 1 to the head 3 of a recipient, who, in the illustrated case, has natural hair 5 on the side and back areas of his scalp, but lacks hair on the top and front areas of his scalp. The illustrated hairpiece is of known construction, comprising a plurality of articial hair filaments 7 secured in a conventional manner to the base element 9. Both the filaments and the base element are commonly made of synthetic materials, with the color and texture of the filaments being selected to resemble and blend with the recipient's natural hair.

The construction of the base element 9, in regard to shape and size, is such that when the hairpiece 1 is properly positioned on the recipient's head 3, the base element conforms to the area of the recipient's head that is covered by the hairpiece, and a portion A of the base element is disposed adjacent to some portion B of the recipient's natural hair 5. It is desirable for a peripheral portion of the base element to lie adjacent natural hair, as shown in FIGS. 2 and 3.

It is essential for the recipient to have some natural hair adjacent the positioned base element, because, as will be seen, the hairpiece is attached using the recipient's natural hair to secure the base element relatively permanently to the recipient's head.

Method of Attaching the Hairpiece

Figure 2:
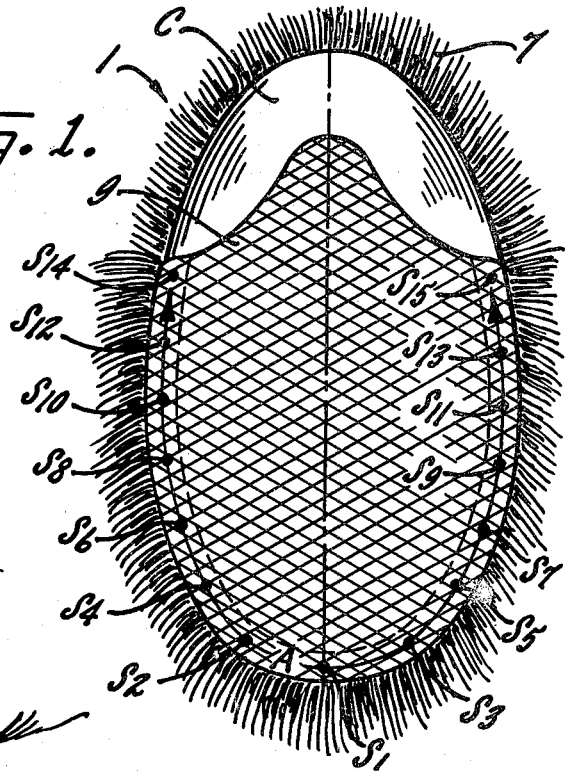
FIG. 2 is an enlarged plan view of the underside of the hairpiece shown in FIG. 1.
Figure 3:
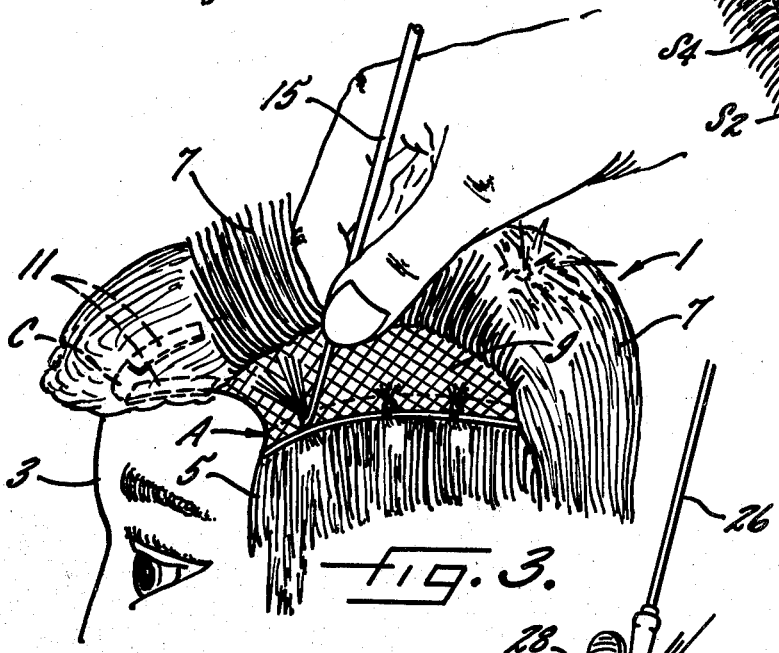
FIG. 3 is a view similar to FIG. 1 after the hairpiece has been positioned on the recipient's head, showing groups of the recipient's natural hair being attached to the base element of the hairpiece at a plurality of attachment sites.

As a preliminary step in the illustrated process of attaching the hairpiece, tape 11 of the type having adhesive surfaces on both sides is applied to the forward under portion C of the base element 9, as indicated in FIGS. 2 and 3. The function of the tape is to cause the front part of the hairpiece to adhere to the area on the front of the recipient's scalp where he has no natural hair. The hairpiece is then manipulated into its intended position on the recipient's head. The tape holds the hairpiece in the intended orientation throughout the rest of the attaching process.

After the hairpiece has been properly positioned on the recipient's head, a series of attachment sites S are selected on the portion A of the base element disposed adjacent natural hair. The operator secures the base element to the recipient's head at these sites, proceeding one site at a time. FIG. 2 illustrates 15 selected attachment sites ($S_1$–$S_{15}$). It is preferred for the first attachment site $S_1$ to be located at the rear of the recipient's head, and for the subsequent sites to proceed forward on alternate sides of the recipient's head. Thus, in the illustrated case, the operator should first attach the hairpiece at site $S_1$, then at site $S_2$, then at site $S_3$, and so on.

To facilitate work, the artificial hair filaments 7 that are attached to the base element 9 in proximity to an attachment site S are pulled over and fastened to one side while the operator is working at that site.

Figure 4:
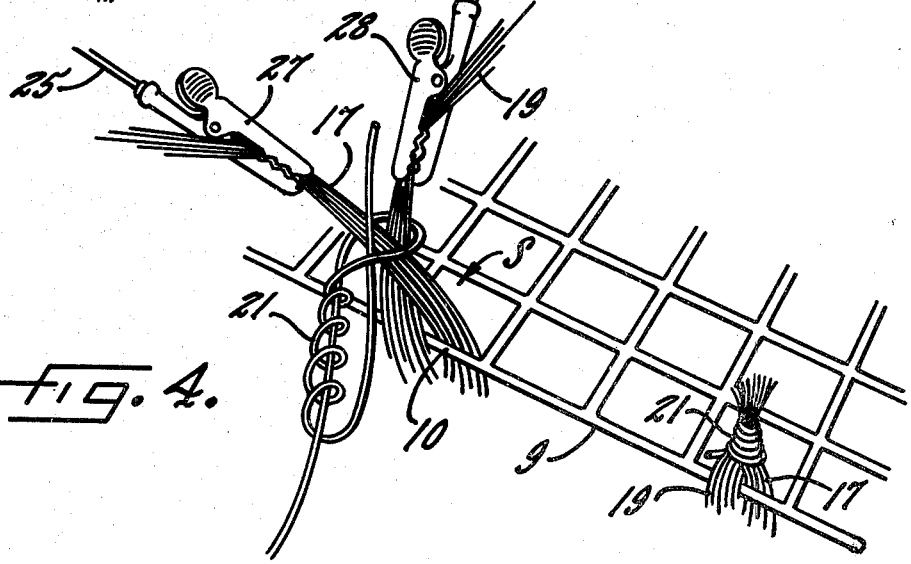
FIG. 4 is an enlarged, fragmentary perspective view of the base element positioned on the recipient's head, showing groups of the recipient's natural hair being attached to the base element.

In effecting attachment at each site, the operator employs a hook tool 15 to reach down through the base element 9 and draw an adjacent group of natural hair 17 through the base element, as illustrated in FIGS. 3 and 4. In the illustrated embodiment, the base element 9 is formed from open-hole netting material, and the group of hair is drawn through a hole of the netting. As shown in FIG. 4, a second, neighboring group of the natural hair is then brought into a position where it can be fastened to the first group, to secure a loop 10 of netting against the recipient's head. If the attachment site is selected at the periphery of the base element, it is not necessary to draw the second group 19 of hair through the netting. It is obvious, however, that if the attachment site is selected at a point other than along the periphery, the hook tool 15 can be used to draw the second group of hair through a neighboring portion of the base element to bring the second group into the required position. It will also be appreciated that the base element could be provided with individual loops along the periphery of the base element at the desired attachment sites, thus dispensing with the necessity of using a base element formed from open-hole netting. A base element formed from open-hole netting is advantageous, however, because in addition to the ventilation such a base permits, it also inherently provides the required fastening loops wherever the base element overlies natural hair.

In accordance with the present invention, the two groups of natural hair 17,19 that are to be fastened together at an attachment site S are held outwardly extended from the recipient's head under a controlled amount of tension, and in an orientation such that the two groups of hair cross against each other at a point adjacent the loop 10, so that the loop is snuggly disposed against the recipient's head. The amount of tension applied in holding the groups of hair is predetermined so as to be comfortable to the recipient. With the two groups of hair and the loop held in this orientation, the operator ties a piece of line 21 around the two groups at their point of crossing, and applies a flowable adhesive substance to the line and to the small portion of hair that is contiguous to the tied line. This permanently secures the loop against the recipient's head.

It is preferred to use an adhesive that sets relatively rapidly. When the adhesive has set, the free ends of the two groups of natural hair are released, and can be trimmed off a short distance above the point of attachment, as shown in FIG. 4.

Device to Assist In Attaching the Hairpiece

In keeping with the invention, means are provided for holding the groups 17,19 of hair at the desired tension and in the desired orientation while the operator is tying the line 21 about the groups of hair, applying the adhesive substance, and waiting for the adhesive to set.

As shown in FIG. 4, the two groups of hair involved in an attaching operation are fastened to lines 25,26 to eliminate the necessity of the operator holding them by hand. The lines are under tension and directed such that the two groups are held in the desired orientation. The lines are attached to the hair by means of clips 27,28 so that the operator can easily attach the lines for the attaching operation and subsequently release the lines when the attaching operation is completed.

Figure 5:
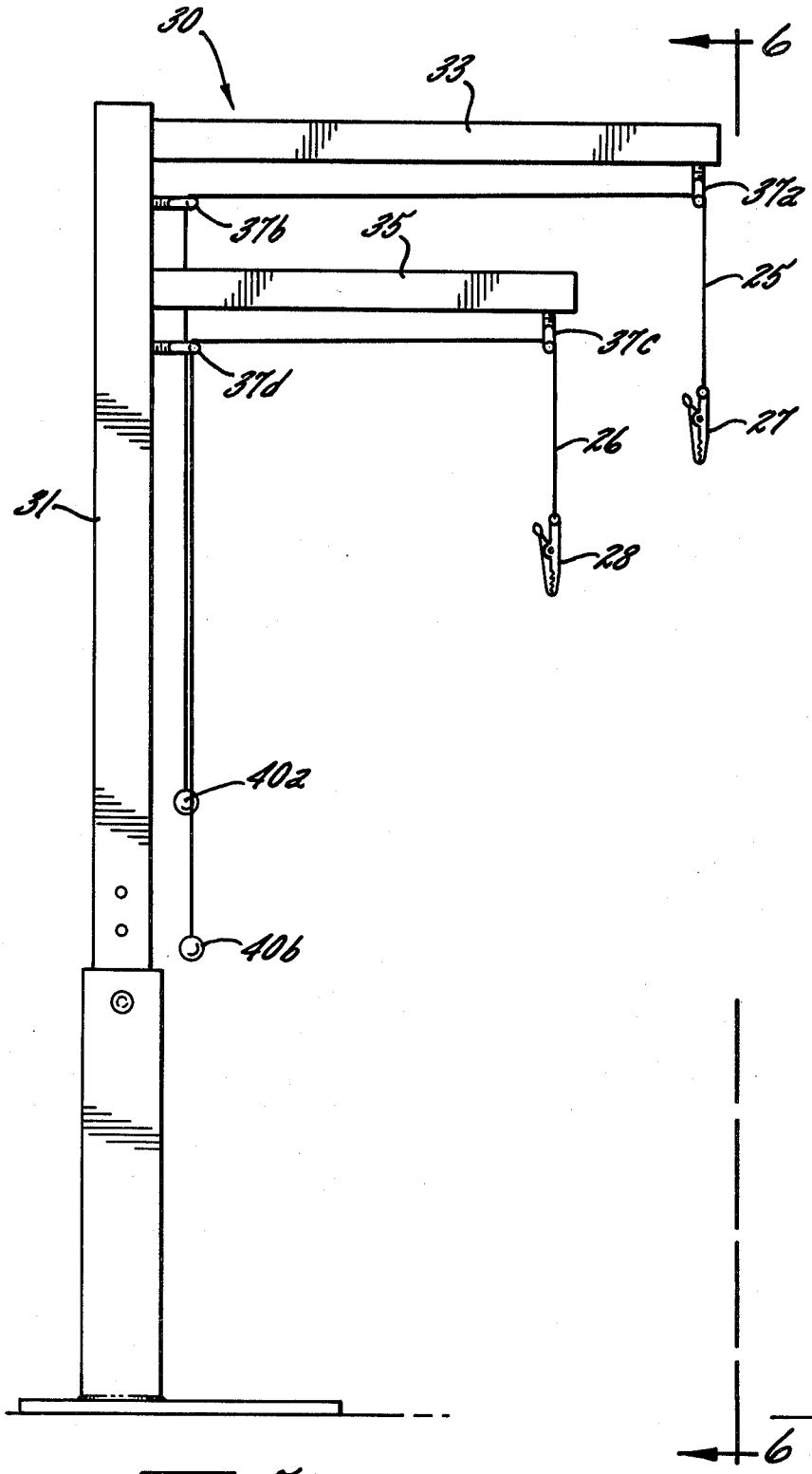
FIG. 5 is an elevational view of a device for assisting an operator in attaching a hairpiece in accordance with the present invention.
Figure 6:
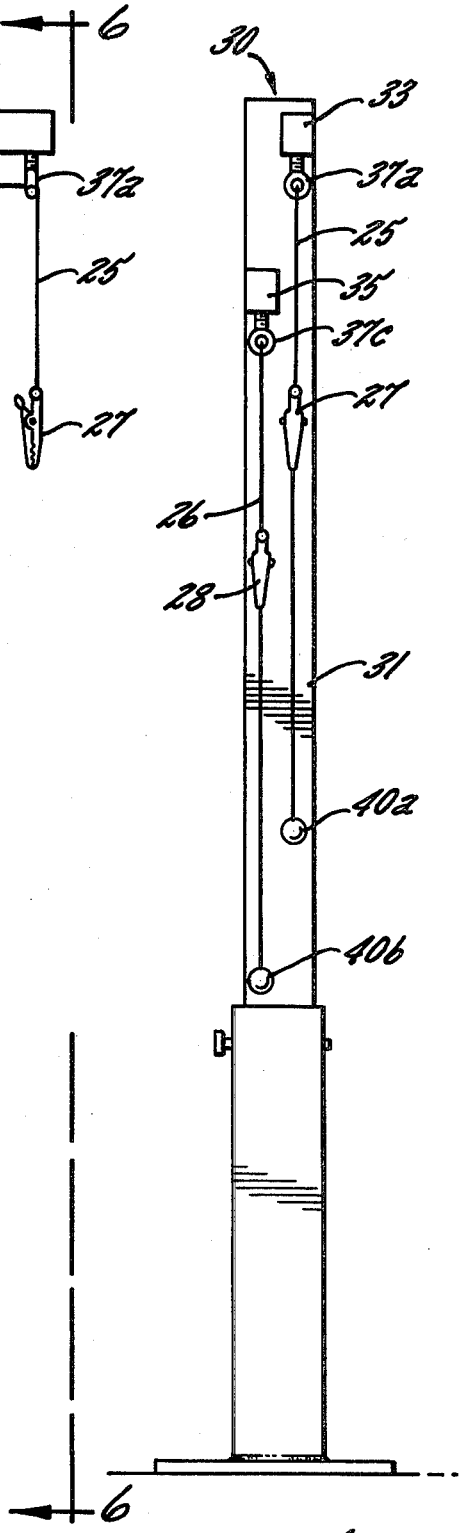
FIG. 6 is a view along line 6—6 of the device shown in FIG. 5.

To control the tension and orientation of the two lines with a minimum of operator attention, the lines are carried on a stand 30 illustrated in FIGS. 5 and 6. The illustrated stand comprises an upright column 31 having two horizontal arms 33,35 that extend in cantilever fashion from the column. The two arms are vertically spaced from each other, and the lower arm 35 is shorter than the upper arm 33. The two are disposed on opposite sides of the upright column's centerline, so as not to be directly on top of each other. To carry the lines 25,26 the stand is provided with a series of guides **37*a*–37*d* that are capable of supporting the lines while at the same time permitting the lines to travel freely through them. The guides in this case are eyelets provided on the underside of each arm 33,35 at ends of the arms furthest from the column (guides 37*a*,37*c*) and on the column beneath each arm (guides 37*b*,37*d*). Each line 25,26 extends from it respective clip 27,28 up to a guide 37*a*,37*c* at the end one of the arms 33,35, under the arm, then through the guide 37*b*,37*d* beneath the arm, and the remaining length of the line hangs alongside the column 31. Tension in each line is provided by attaching small weights 40*a*,40*b* to the end of the line 25,26 that hangs alongside the column 31**. The tension can be varied by removing or adding weights to the lines. Thus, if a particular recipient experiences any discomfort due to the amount of tension being used, a simple adjustment in the amount of weight used can be made to eliminate this problem.

In practice of the invention, the recipient is seated beneath the arms 33,35 of the stand 31. After the hairpiece 1 has been positioned on the recipient's head 3, and a first group 17 of natural hair has been pulled through a loop 10 of the base element 9 at an attachment site S, the clip 27 end of one of the lines 25 is drawn down to the group of hair, against the opposing force of the weight **40*a* that is attached to the other end of the line, and the clip is fastened to the group hair so that the line holds the hair outwardly extended from recipient's head. A second, neighboring group 19 of natural hair is then selected, the clip 28 of the second line 26 is drawn down, against the opposing force of the weight 40*b* attached to its opposite end, and the clip is fastened to the second group of hair so that it, too, is held outwardly extended from the recipient's head. Due to the separation of the ends of the two arms 33,35 of the stand, and the resulting separation of the guides 36*a*,37*c* disposed at the end of the arms, the lines 25,26 that hold the two groups 17,19 of natural hair at different angles. With the recipient's head properly located beneath the arms, the two groups of natural hair can be oriented so as to cross over and against each other a short distance above the recipient's scalp, snuggly disposing the loop 10** against the scalp. If desired, the stand could be provided with guides that are moveable on the arms to various distances from the column, thus providing the ability to vary the separation of the guides and providing greater flexibility in achieving the desired orientation of groups of hair. Similarly, the stand could be constructed to permit selective vertical adjustment of the arms.

Thus, as has been seen, the present invention provides an improved method of attaching a hairpiece which utilizes the recipient's hair, but which does not require cumbersome twisting and knotting of the hair. The method can be readily used where the recipient has a short hair style. It enables the operator to use both hands in fastening the recipient's natural hair to the hairpiece, provides greater comfort for the recipient while the hairpiece is being attached, and results in stronger and more uniform bonds.

I claim:

1. A method of attaching a hairpiece to the head of a recipient having at least some natural hair with the use of apparatus that includes two lines each having one end for attachment to the hair and the other end for attaching selected line tension weights, the hairpiece having a plurality of loops to which natural hair can be secured, comprising the steps of:

(a) positioning the hairpiece on the head of the recipient so that a series of the loops are disposed adjacent the recipient's natural hair;

(b) pulling a first group of the natural hair through an adjacent loop at a first attachment site;

(c) securing a first line to the end of said first group of hair;

(d) orienting said line and the first group of hair secured thereto to a predetermined angle with respect to the head of the recipient;

(e) applying a weight of preselected size to the other end of said line so as to impart a controlled amount of tension to said line and the group hair secured thereto such that said first group of hair is held without manual assistance in predetermined outwardly extending orientation with respect to said head;

(f) pulling a second group of natural hair adjacent said first attachment site outwardly from the recipient's head;

(g) securing a second line to the ends of said second group of hair;

(h) orienting said second line and said second group of hair attached thereto to a predetermined angle to the head while said first group of hair is held by said first line such that the first and second groups cross against each other over the loop;

(i) applying a weight of preselected size to the other end of said second line so as to impart a controlled amount of tension to said second line and said second group of hair secured thereto so that said first and second crossing groups of hair dispose the loop against the recipients head without manual assistance;

(j) securing together said two groups of hair while they are held in crossing relation extending outwardly from the recipient's head by said first and second lines so as to secure said loop in position on the head; and (k) detaching said first and second lines from said groups of hair.

2. The method of claim 1 in which said first and second groups of hair are secured together by first tying a line about the groups of hair and then applying a flowable adhesive substance to the tied line.

* * * * *